US007148847B2

(12) United States Patent
Yuanzhu

(10) Patent No.: US 7,148,847 B2
(45) **Date of Patent: *Dec. 12, 2006**

(54) SMALL-SIZE, LOW-HEIGHT ANTENNA DEVICE CAPABLE OF EASILY ENSURING PREDETERMINED BANDWIDTH

(75) Inventor: Dou Yuanzhu, Fukushima-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 46 days.

This patent is subject to a terminal disclaimer.

(21) Appl. No.: 10/926,111

(22) Filed: Aug. 25, 2004

(65) Prior Publication Data

US 2005/0057416 A1 Mar. 17, 2005

(30) Foreign Application Priority Data

Sep. 1, 2003 (JP) ..... 2003-308709

(51) Int. Cl.
*H01Q 1/38* (2006.01)

(52) U.S. Cl. ..... 343/700 MS; 343/702

(58) Field of Classification Search ..... 343/700 MS, 343/702, 846, 848, 711, 712, 713
See application file for complete search history.

(56) References Cited

U.S. PATENT DOCUMENTS 5,966,097 A * 10/1999 Fukasawa et al. ... 343/700 MS
6,552,686 B1 * 4/2003 Ollikainen et al. .. 343/700 MS
6,597,317 B1 * 7/2003 Talvitie ..... 343/700 MS
2001/0050643 A1 * 12/2001 Egorov et al. ..... 343/702

FOREIGN PATENT DOCUMENTS

JP 2003-133843 5/2003
JP 2004-104419 4/2004

* cited by examiner

*Primary Examiner*—Hoanganh Le
(74) *Attorney, Agent, or Firm*—Brinks Hofer Gilson & Lione

(57) ABSTRACT

The antenna device 1 contains a first radiating conductive plate 3 arranged above a grounding conductor 2 so as to be substantially parallel and opposite to the grounding conductor 2; a second radiating conductive plate 4 adjacent to the first radiating conductive plate 3 with a slit 5 interposed therebetween; a feeding conductive plate 6 that extends orthogonally from an outer edge of the first radiating conductive plate 3 adjacent to the slit 5, and a shorting conductive plate 7 that extends orthogonally from an outer edge of the second radiating conductive plate 4 adjacent to the slit 5. A lower end of the feeding conductive plate 6 is connected to a feeding circuit, and a lower end of the shorting conductive plate 7 is connected to the grounding conductor 2.

4 Claims, 2 Drawing Sheets

SMALL-SIZE, LOW-HEIGHT ANTENNA DEVICE CAPABLE OF EASILY ENSURING PREDETERMINED BANDWIDTH

This application claims the benefit of priority to Japanese Patent Application No. 2003-308709, herein incorporated by reference.

BACKGROUND OF THE INVENTION

1. Field of the Invention

The present invention relates to a small-size, low-height antenna device that is suitably used for an automobile antenna or a portable antenna.

2. Description of the Related Art

Conventionally, as an antenna device which can be suitably implemented as a small-size, low-height antenna device, a T-shaped monopole antenna comprising a band-shaped conductor which is provided on a grounding conductor, and whose lower end is connected to a feeding circuit; and an upper conductor which is arranged above the grounding conductor so as to be substantially parallel and opposite to the grounding conductor and whose center is connected to an upper end of the band-shaped conductor, has been suggested (for example, refer to Japanese Unexamined Patent Application Publication No. 2003-133843 (page 3, FIG. 1). In such a monopole antenna, the upper conductor is disposed on a capacitor region having a large voltage change, a capacitance value becomes high, and an electric field is reduced. As a result, the height of the entire antenna can be reduced to facilitate the effort in decreasing the overall size of antennas. By supplying a power to the band-shaped conductor, it is possible to operate the upper conductor as a radiating element.

In addition, as the reduction in size of antenna devices becomes more required, an inverted F-type antenna has been conventionally adopted, which comprises a radiating conductive plate arranged above a grounding conductor so as to be substantially parallel and opposite to the grounding conductor; a feeding conductive plate that extends orthogonally from an outer edge of the radiating conductive plate and is connected to a feeding circuit; and a shorting conductive plate that extends orthogonally from an outer edge of the radiating conductive plate and is connected to the grounding conductor. In such an inverted F-type antenna, by supplying a power to the feeding conductive plate, it is possible to operate the radiating conductive plate to the radiating element, and by suitably selecting a position of forming the shorting conductive plate, impedance mismatching can be easily avoided. Accordingly, the height of the entire antenna can be made still smaller.

However, in automobile antenna devices or portable antenna devices, since the antenna devices are required to be smaller and shorter in size, the above-mentioned T-shaped monopole antenna or inverted F-type antenna device have been widely adopted. Generally, the antenna device has a characteristic that by making the antenna device smaller and shorter in size, a bandwidth capable of being resonated becomes narrower. As a result, when making the above-mentioned conventional T-shaped monopole antenna or inverted F-type antenna smaller and shorter in size, there was a fear that it is impossible to ensure a predetermined bandwidth. Here, the bandwidth is in the frequency range in which a return loss (reflection attenuation quantity) is not more than −10 dB. But, the antenna device must ensure a bandwidth wider than the bandwidth of a use frequency. For this reason, making the antenna smaller and shorter in size becomes a difficult process.

SUMMERY OF THE INVENTION

Accordingly, the present invention has been made in consideration of the above-mentioned problems, and it is an object of the present invention to provide an antenna device capable of easily ensuring a predetermined bandwidth even when the antenna device is made smaller and shorter in size.

In order to achieve the above-mentioned object, the present invention provides an antenna device which comprises a first radiating conductive unit arranged above a grounding conductor so as to be substantially parallel and opposite to the grounding conductor; a feeding conductive unit that extends orthogonally from an outer edge of the first radiating conductive unit and is connected to a feeding circuit; a second radiating conductive unit arranged above the grounding conductor so as to be substantially parallel and opposite to the grounding conductor and adjacent to the first radiating conductive unit with a slit interposed therebetween; and a shorting conductive unit that extends orthogonally from an outer edge of the second radiating conductive unit and is connected to the grounding conductor. Here, the shorting conductive unit is disposed in the vicinity of the feeding conductive unit and then the shorting conductive unit is electromagnetically coupled with the feeding conductive unit.

In the antenna device having the above-mentioned configuration, when supplying a power to the feeding conductive unit located at the first radiating conductive unit side, an induced current flows through the shorting conductive unit located at the second radiating conductive unit side, to make it possible to operate the second radiating conductive unit as a radiating element of a parasitic antenna. Thus, in the antenna device, two resonance points different from each other can be set. In addition, the resonance frequency difference between the two resonance points can be increased or decreased by suitably adjusting the electromagnetic coupling intensity between the feeding conductive unit and the shorting conductive unit. Therefore, even when the antenna device is made smaller and shorter in size, it is possible to easily ensure a predetermined bandwidth by widening the frequency range in which a return loss is not more than a predetermined value.

In the antenna device having the above-mentioned configuration, it is preferable that the feeding conductive unit extend orthogonally from the outer edge of the first radiating conductive unit adjacent to the slit and the shorting conductive unit extend orthogonally from the outer edge of the second radiating conductive unit adjacent to the slit. In this manner, the feeding conductive unit and the shorting conductive unit can be electromagnetically coupled with each other with ease.

In addition, in the antenna device having the above-mentioned configuration, it is preferable that the first and second radiating conductive units, the feeding conductive unit, and the shorting conductive unit be composed of a metal plate. In this manner, it is possible to obtain an antenna device that is easy to manufacture with a low cost.

In addition, when the antenna device having the above-mentioned configuration comprises a shorting conductive unit for matching that extends orthogonally from the outer edge of the first radiating conductive unit and is connected to the grounding conductor, the impedance mismatching can be easily avoided by suitably selecting a position of forming the shorting conductive unit for matching impedance. As a result, the height of the entire antenna device can be made even smaller. In this case, it is preferable that the shorting conductive plate for matching impedance be composed of a metal plate. Accordingly, it is possible to obtain an antenna device, which is easy to manufacture at a low cost and which is very useful in reducing the height of the entire antenna.

According to the antenna device of the present invention, the feeding conductive unit located at the first radiating conductive unit side is electromagnetically coupled with the shorting conductive unit located at the second radiating conductive unit side, to operate the second radiating conductive plate as the radiating element of the parasitic antenna. As a result, two resonance points are generated. In addition, the resonance frequency difference between the two resonance points can be increased or decreased by suitably adjusting the electromagnetic coupling intensity between the feeding conductive unit and the shorting conductive unit. Therefore, even when the antenna de-vice is made smaller and shorter in size, it is possible to easily ensure a predetermined bandwidth.

DESCRIPTION OF THE PREFERRED EMBODIMENTS

Figure 1:
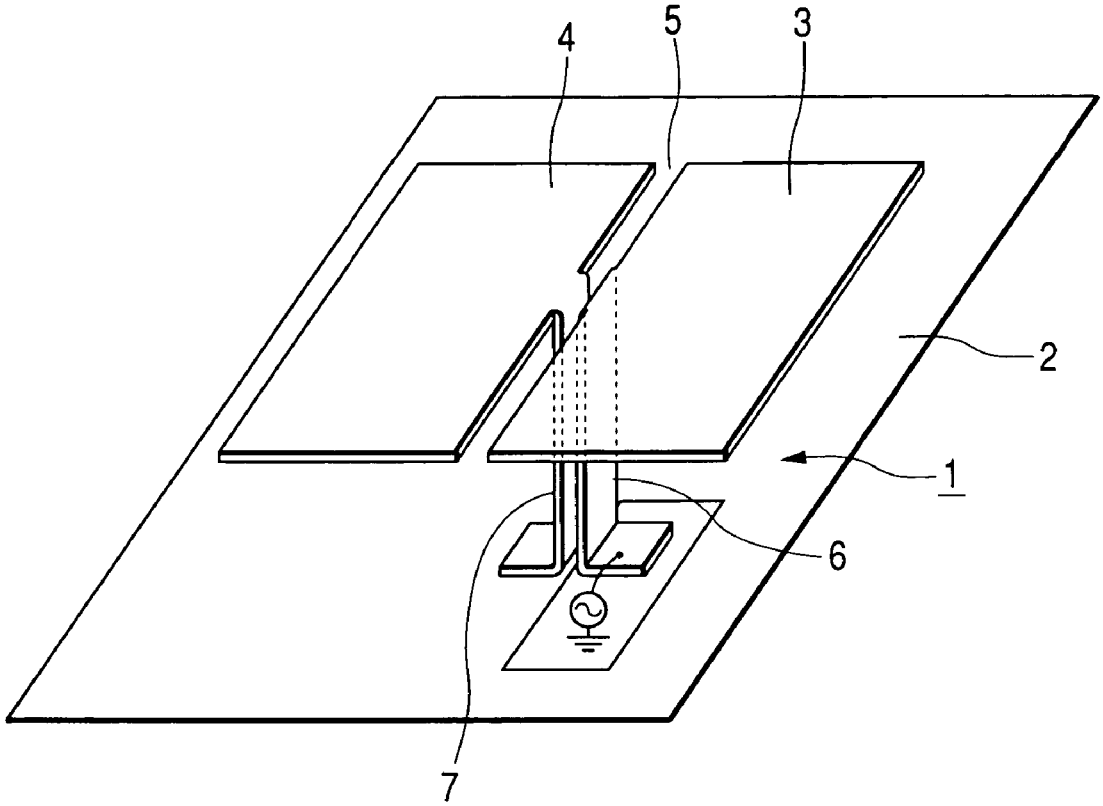
FIG. 1 is a perspective view showing an antenna device according to a first embodiment of the present invention.
Figure 2:
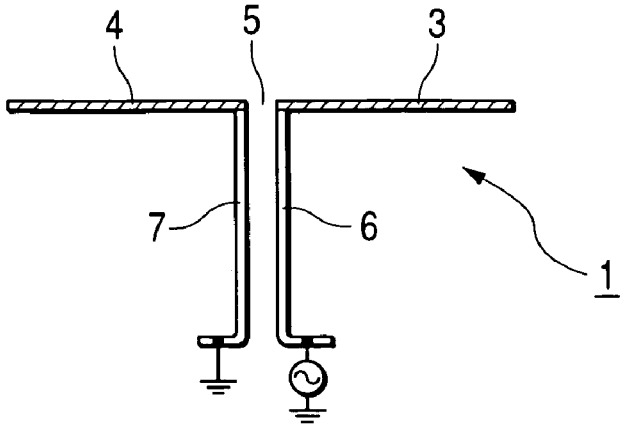
FIG. 2 is a partial cross-sectional side view showing the antenna device according to the first embodiment of the present invention.
Figure 3:
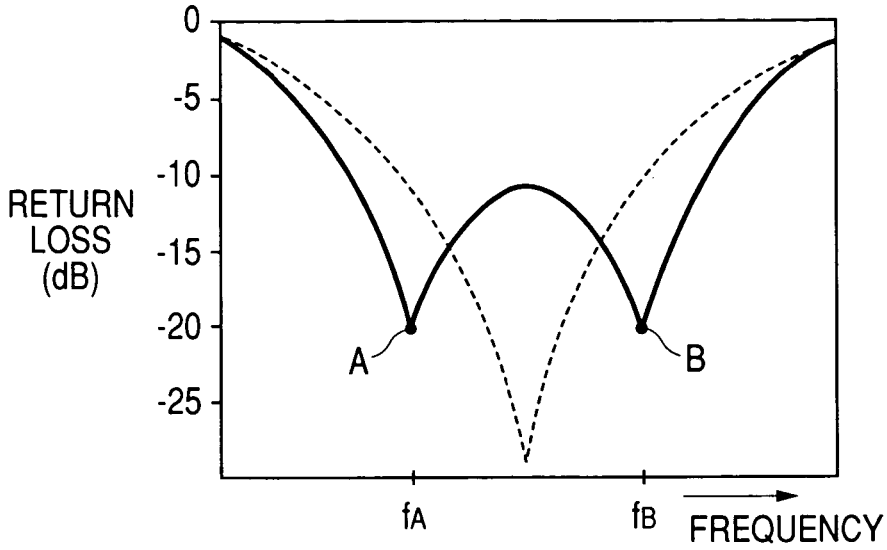
FIG. 3 is a characteristic view showing a return loss of the antenna device according to the first embodiment of the present invention.

Embodiments of the present invention will be now described with reference to the accompanying drawings. FIG. 1 is a perspective view showing an antenna device according to a first embodiment of the present invention; FIG. 2 is a partial cross-sectional side view showing the antenna device according to the first embodiment of the present invention; and FIG. 3 is a characteristic view showing a return loss in accordance with a frequency of the antenna device according to the first embodiment of the present invention.

As shown in FIGS. 1 and 2, an antenna device 1 is composed of a sheet metal formed by bending a conductive metal plate such as a copper plate, which is fixed on a surface of grounding conductor 2. The antenna device 1 comprises a first radiating conductive plate 3 and a second radiating conductive plate 4 arranged above the grounding conductor 2 so as to be substantially parallel and opposite to the grounding conductor 2, a slit 5 provided between the first radiating conductive plate 3 and the second radiating conductive plate 4, a feeding conductive plate 6 that extends orthogonally from an outer edge of the first radiating conductive plate 3 adjacent to the slit 5, and a shorting conductive plate 7 that extends orthogonally from an outer edge of the second radiating conductive plate 4 adjacent to the slit 5. The first radiating conductive plate 3 and the second radiating conductive plate 4 have shapes similar to each other. The first radiating conductive plate 3 and the second radiating conductive plate 4 are arranged parallel to each other according to a line-symmetrical position relationship using the slit 5 as an axis of symmetry. A lower end of the feeding conductive plate 6 is connected to a feeding circuit (not shown), and a lower end of the shorting conductive plate 7 is connected to the grounding conductor 2. In addition, since the feeding conductive plate 6 and the shorting conductive plate 7 are adjacently arranged so as to be opposite to each other with the slit 5 interposed therebetween, the feeding conductive plate 6 and the shorting conductive plate 7 have a relatively strong electromagnetic coupling when a power is supplied to the antenna device 1.

In other words, when a power is supplied to the antenna device 1, a predetermined high frequency power is supplied to the feeding conductive plate 6 and to thus resonate the first radiating conductive plate 3. At this time, since an induced current flows through the shorting conductive plate 7 by an electromagnetic coupling between the feeding conductive plate 6 and the shorting conductive plate 7, it is possible to operate the second radiating conductive plate 4 as a radiating element of a parasitic antenna. Thus, a return loss (reflection attenuation quantity) according to a frequency of the antenna device 1 forms a curved line as shown by a solid line in FIG. 3, and two resonance points A and B different from each other are generated. Here, when the electromagnetic coupling intensity between the feeding conductive plate 6 and the shorting conductive plate 7 increases or decreases by changing relative positions between the feeding conductive plate 6 and the shorting conductive plate 7, resonance frequencies corresponding to the resonance points A and B also are changed. Accordingly, when the electromagnetic coupling intensity between the feeding conductive plate 6 and the shorting conductive plate 7 is suitably adjusted and then a return loss at any frequency in a range of a resonance frequency f(A) corresponding to the resonance point A to a resonance frequency f(B) corresponding to the resonance point B, is not more than −10 dB, and when it is designed such that a frequency difference between the resonance frequency f(A) and the resonance frequency f(B) increases significantly, it is possible to drastically widen a bandwidth.

For example, when the feeding conductive plate 6 and the shorting conductive plate 7 are in close proximity to each other and the electromagnetic coupling intensity between the feeding conductive plate 6 and the shorting conductive plate 7 is drastically intensified, the resonance frequency f(A) and the resonance frequency f(B) have values substantially equal to each other, and thus the bandwidth thereof becomes narrower. In contrast, when the feeding conductive plate 6 and the shorting conductive plate 7 are apart from each other as far as possible and the electromagnetic coupling intensity between the feeding conductive plate 6 and the shorting conductive plate 7 is weakened, the frequency difference between the resonance frequency f(A) and the resonance frequency f(B) increases gradually, and thus the bandwidth thereof becomes wider. However, when the electromagnetic coupling intensity between the feeding conductive plate 6 and the shorting conductive plate 7 is weakened, the return loss with regard to signal waves at a predetermined frequency in the range of the resonance frequency f(A) to the resonance frequency f(B), exceeds −10 dB. As a result, it is difficult to noticeably widen a bandwidth. Therefore, when the electromagnetic coupling intensity between the feeding conductive plate 6 and the shorting conductive plate 7 is suitably adjusted and the resonance points A and B are set as shown in FIG. 3, the frequency range in which the return loss is not more than −10 dB is maximized, consequently the band width can be significantly widened. In addition, a curved line shown by a dot line in FIG. 3 shows the return loss in a conventional T-shaped monopole antenna. In the conventional T-shaped monopole antenna, since the resonance point thereof is only one, the bandwidth is narrower than that of the present embodiment.

As such, since the antenna device 1 according to the present embodiment can operate the second radiating conductive plate 4 as a radiating element of a parasitic antenna, two resonance points A and B can be set. In addition, since the resonance points A and B which are useful in widening the bandwidth are set by suitably adjusting the electromagnetic coupling intensity between the feeding conductive plate 6 and the shorting conductive plate 7, it is possible to easily ensure a predetermined bandwidth even when the entire antenna is made smaller and shorter in size. Thus, according to the antenna device 1 of the present embodiment, it is easy to make the antenna smaller and shorter in size, and widen the bandwidth compared to the conventional T-shaped monopole antenna. In addition, since the antenna device 1 is composed of a sheet metal that is easily formed by bending a conductive metal plate, it is possible to manufacture the antenna at a low cost.

Figure 4:
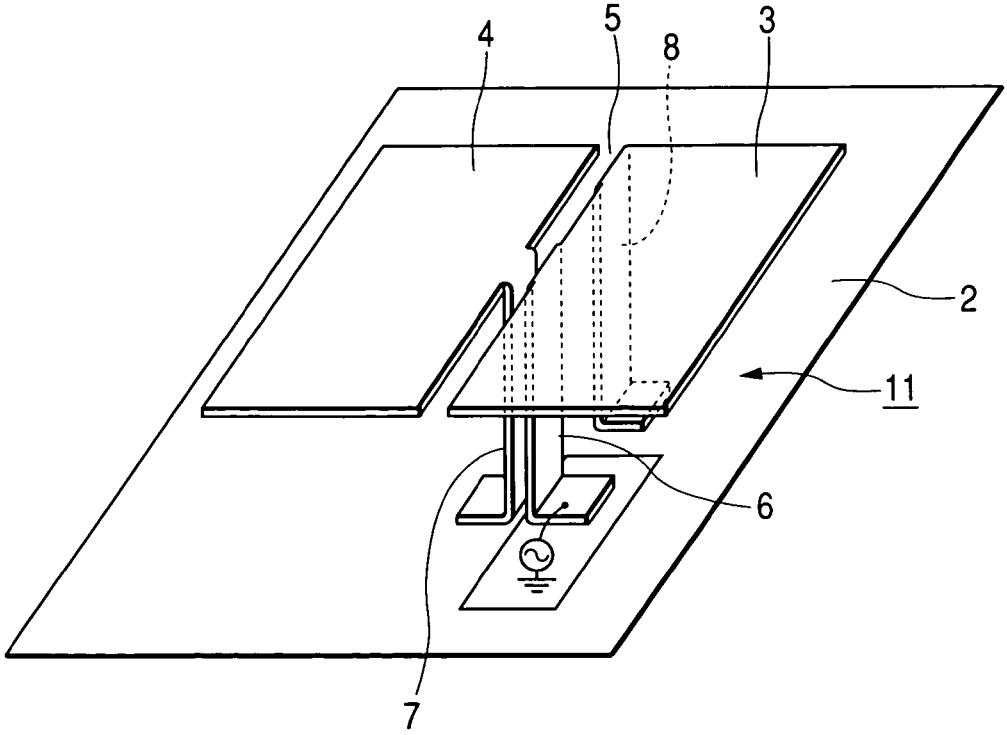
FIG. 4 is a perspective view showing an antenna device according to a second embodiment of the present invention.

FIG. 4 is a perspective view showing an antenna device according to a second embodiment of the present invention. In FIG. 4, the constituent elements same or similar to those in FIG. 1 are indicated by the same or similar reference numerals.

An antenna device 11 according to the second embodiment is different from the antenna device 1 according to the first embodiment in that a shorting conductive plate 8 for matching impedance by which a first radiating conductive plate 3 is connected to a grounding conductor 2 is provided. The shorting conductive plate 8 extends orthogonally from an outer edge of the first radiating conductive plate 3 such that a lower end of the shorting conductive plate 8 is connected to the grounding conductor 2. In addition, by suitably changing a position of forming the shorting conductive plate 8, impedance mismatching can be easily avoided. Accordingly, the height of the entire antenna can be made still smaller.

What is claimed is:

1. An antenna device, comprising:

a first radiating conductive unit arranged above a grounding conductor so as to be substantially parallel and opposite to the grounding conductor;

a feeding conductive unit that extends orthogonally from an outer edge of the first radiating conductive unit to be connected to a feeding circuit;

a second radiating conductive unit arranged above the grounding conductor so as to be substantially parallel and opposite to the grounding conductor and adjacent to the first radiating conductive unit with a slit interposed therebetween, the second radiating conductive unit being configured approximately in the same form as that of the first radiating conductive unit; and a shorting conductive unit that extends orthogonally from an outer edge of the second radiating conductive unit to be connected to the grounding conductor, wherein the feeding conductive unit extends from an outer edge of the slit side of the first radiating conductive unit; and the shorting conductive unit extends from an outer edge of the slit side of the second radiating conductive unit, wherein the shorting conductive unit is disposed in the vicinity of the feeding conductive unit and is electromagnetically coupled with the feeding conductive unit.

2. The antenna device according to claim 1, wherein the first and second radiating conductive units, the feeding conductive unit, and the shorting conductive unit are composed of a metal plate.

3. The antenna device according to claim 1, further comprising:

a shorting conductive unit for matching impedance, wherein the shorting conductive unit for matching impedance extends orthogonally from an outer edge of the first radiating conductive unit and is connected to the grounding conductor.

4. The antenna device according to claim 3, wherein the shorting conductive unit for matching impedance is composed of a metal plate.

* * * * *